US007108533B2

(12) United States Patent
Howard

(10) Patent No.: US 7,108,533 B2
(45) Date of Patent: Sep. 19, 2006

(54) MALE/FEMALE CONNECTOR ASSEMBLY FOR CONNECTING ELECTRICAL CONDUCTORS

(75) Inventor: Stephen M Howard, The Colony, TX (US)

(73) Assignee: R.A. Phillips Industries, Inc., Sante Fe Spring, CA (US)

( * ) Notice: Subject to any disclaimer, the term of this patent is extended or adjusted under 35 U.S.C. 154(b) by 8 days.

(21) Appl. No.: 11/049,838

(22) Filed: Feb. 1, 2005

(65) Prior Publication Data

US 2006/0172577 A1 Aug. 3, 2006

Related U.S. Application Data

(60) Provisional application No. 60/647,724, filed on Jan. 26, 2005.

(51) Int. Cl.
*H01R 25/00* (2006.01)

(52) U.S. Cl. ..... 439/282

(58) Field of Classification Search ..... 439/282
See application file for complete search history.

(56) References Cited

U.S. PATENT DOCUMENTS 3,221,292 A * 11/1965 Swanson et al. ..... 439/589
5,273,443 A * 12/1993 Frantz et al. ..... 439/595
6,319,039 B1 * 11/2001 Chambly ..... 439/282

* cited by examiner

*Primary Examiner*—Briggitte R. Hammond
(74) *Attorney, Agent, or Firm*—Jones Day

(57) ABSTRACT

A connector assembly is disclosed and claimed. The male connector comprises at least one conductive terminal held by a male plug body including a head portion and a gripping portion, the head portion including a plurality of raised elements extending radially outward from the head portion. The female connector comprises at least one mating conductive terminal held by a female plug body including a receiving portion and a gripping portion, the receiving portion adapted to receive the head portion of the male connector and including a plurality of recessed areas adapted to interlock with the raised elements of the head portion. The male plug body is preferably made from a substantially rigid plastic and the female plug body is made from a flexible plastic.

1 Claim, 11 Drawing Sheets

MALE/FEMALE CONNECTOR ASSEMBLY FOR CONNECTING ELECTRICAL CONDUCTORS

RELATED APPLICATIONS

The present application claims priority under 35 U.S.C. § 119(e) to the U.S. Provisional Application No. 60/647,724, filed Jan. 26, 2005 for a MALE/FEMALE CONNECTOR ASSEMBLY FOR CONNECTING ELECTRICAL CONDUCTORS, which is incorporated herein by reference as if set forth in its entirety.

BACKGROUND OF THE INVENTION

1. Field of the Invention

This invention comprises a connector for connecting electrical conductors, and in particular, a connector for use in the tractor/trailer industry, so that the conductors are maintained in protected contact.

2. Brief Description of the Field

Many connector designs have been proposed for use in connecting electrical conductors. Many of these connectors are very effective in the applications for which they are designed. Unfortunately, a connector designed for connecting an electrical conductor to a household outlet is not likely to be effective when used as a connector for heavy equipment, such as, over-the-road semi-trailer trucks and the like. Connectors for such applications must be watertight and must be resistant to separation under conditions of vibration and the like. Further, such connectors must be rugged to withstand abrasion and other detrimental contacts during use.

Connectors used in semi-trailers or tractors are frequently used in the electrical harness assemblies of such vehicles. Such connectors are subjected to almost continual vibration and are exposed to water, salt water, abrasive materials and the like. It is vital that such connectors remain in effective electrical connection to ensure safe operation of the vehicles. Connectors of the type disclosed here are often used in so-called "semi-permanent" applications in the trucking industry where it is important that the connection stay securely connected for long periods of time, during often harsh conditions. However, it is also important that they be able to be connected without significant difficulty. It is preferable, then, that an electrical connector assembly require an insertion force which is substantially less than the force required for disengaging the female and male components of the connector.

Another deficiency of prior connectors is their size. Conventional connectors with seven 0.180 inch pins have typically been round and at least 1.25 inches in diameter. There exists a need, however, in the trailer industry for harness connectors having a smaller form factor, and in particular, for a connector with seven 0.180 inch pins that have a height of less than 1.1 inches, preferably less than 1.05 inches. The need for such a product has been well known in the industry for at least 15 months. Despite this need, until the present invention, limitations in conventional injection molding processes and connector designs have made it impractical to reduce the size of the connector body. For example, it was previously considered necessary to design connector bodies so as to provide a substantial buffer zone around the wires leading to the terminals in the connector. One reason for this is that the wires tend to become displaced during the injection molding process. If the wires move too close to the surface of the connector body during the molding process, the manufacturing process frequently leaves the wire exposed through a side wall of the connector, rendering the part defective and useless.

Another deficiency in prior art connectors is that the injection point for injecting the mold tends to leave a substantial protuberance, which must be removed, increasing the cost of manufacture.

And, while many attempts have been made to develop improved connectors for electrical conductors for use in semi-trailers or tractors and many processes have been used to make such connectors, all of the prior connectors used identical materials for both the male and female connector bodies. Typically, a polyvinyl chloride plastic ("PVC") having a hardness of 60 A to 75 A on the Shore hardness scale was used.

All of the major commercially used connector assemblies for the tractor/trailer industry require a separate clamp, pin or other device to ensure a strong, well-sealed semi-permanent connection. This is a serious drawback for those connector assemblies because the clamps are cumbersome and awkward to use and, frequently, are simply not used by truckers, resulting in a high risk of electrical failure. Thus, notwithstanding the availability of a variety of connectors, a need remains for an electrical conductor connector that can ensure reliable waterproof contact during use, as well as provides a viable semi-permanent connection, even when an external clamp is not used. A need also remains for connectors for harness assemblies having a reduced form factor.

SUMMARY OF THE INVENTION

The present invention is directed to a semi-permanent connector assembly and a method of manufacturing the same. To this end, a connector assembly is provided comprising a male connector and a female connector. The male connector comprises at least one conductive terminal held by a male plug body including a head portion and a gripping portion. The head portion includes a plurality of raised elements extending radially outward from the head portion. The female connector comprises at least one mating conductive terminal held by a female plug body including a receiving portion and a gripping portion. The receiving portion is adapted to receive the head portion of the male connector and includes a plurality of recessed areas adapted to interlock with the raised elements of the head portion. The at least one conductive terminal held by the female plug body is configured to mate with the at least one conductive terminal of the male plug body when the head portion is received by the receiving portion.

Preferably, the male plug body is made from a substantially rigid plastic and the female plug body is made from a flexible plastic. Preferably, the male plug body has a hardness that is greater than about 80 A on the Shore hardness scale, more preferably greater than 85 A and less than 100 A, and even more preferably about 90 A or greater. Preferably the hardness of the female plug body is less than about 80 A, more preferably greater than or equal to about 60 A and less than or equal to about 80 A, and even more preferably about 75 A.

The raised elements may comprise, for example, a plurality of saw-tooth shaped ridges. However, other shapes may also be employed. The plurality of raised elements preferably comprise a D-shaped O-Ring, as shown in the figures and drawings, as the forward-most raised ridge.

In a preferred embodiment, the head portion preferably comprises a wiper seal blade extending radially from the head portion at its distal end, or aft of the plurality of raised ridges. Further, the receiving portion preferably has no corresponding recessed area for receiving the wiper seal.

Preferably the head portion and the gripping portion of the male plug body are integrally formed in an injection molding process. Similarly, the receiving portion and the gripping portion of the female plug body are also preferably integrally formed in an injection molding process. Preferably, the gripping portions of the male and female plug bodies are mirror images of one another. In a particularly preferred embodiment, the plug bodies have rounded lateral walls with lateral ribs extending along a majority of the length of the respective plug bodies. Further, the plug bodies preferably have flat top and bottom portions. With the foregoing construction, a semi-permanent 7-pin connector assembly employing 0.180 inch pins may be made having a height of less than 1.100 inches, and even less than 1.05 inches, without having the wires move to the surface of the plug body during the molding process.

Further objects, advantages, and desirable features of the invention will be better understood from the following description considered in connection with the accompanying drawings in which various embodiments of the invention are illustrated by way of example. It is to be expressly understood, however, that the drawings are for the purpose of illustration only and are not intended as a definition of the limits of the invention.

DETAILED DESCRIPTION OF THE INVENTION

Figure 1:
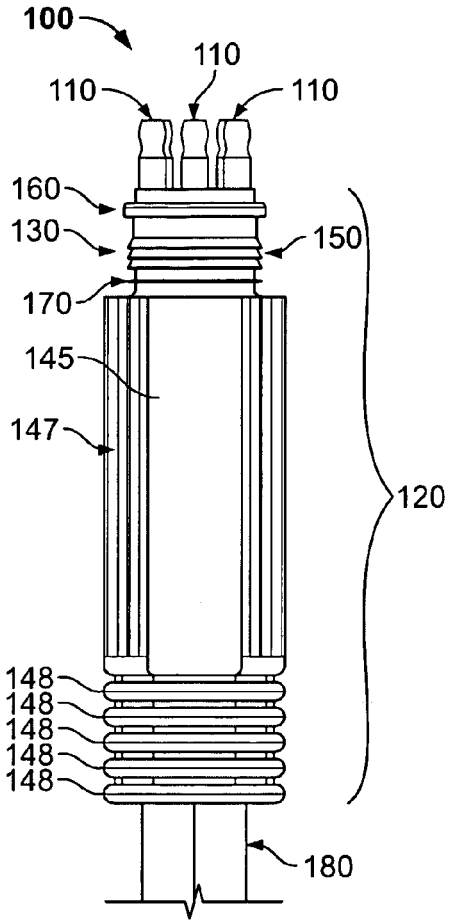
FIG. 1 is a top view of an embodiment of a male connector of the present invention.
Figure 2:
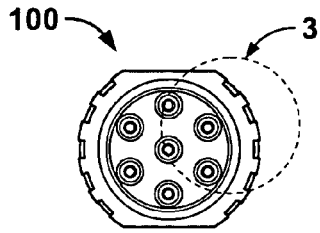
FIG. 2 is frontal view of the male connector of FIG. 1.
Figure 3:
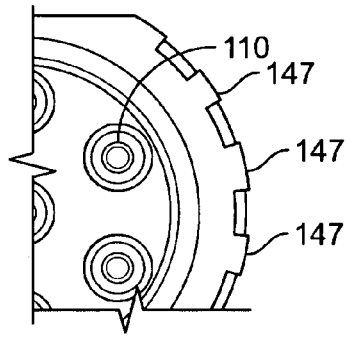
FIG. 3 is an enlarged view of FIG. 2.
Figure 4:
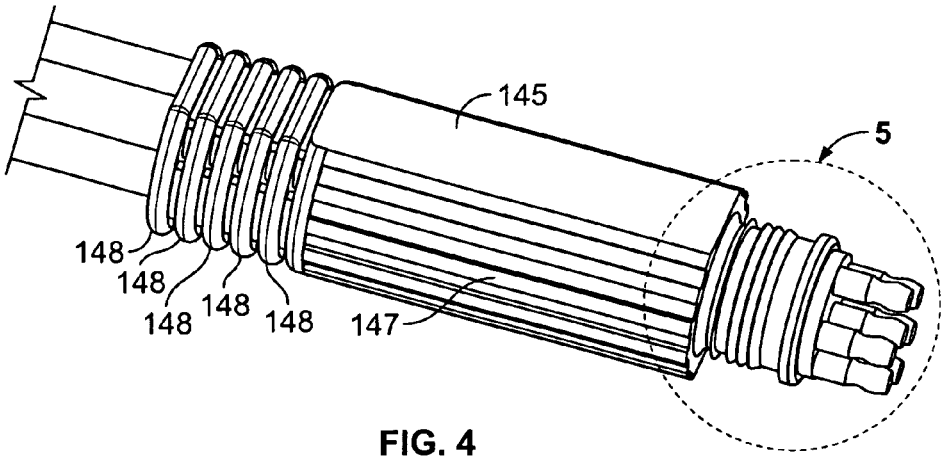
FIG. 4 is a perspective view of the male connector of FIG. 1.

To facilitate the description of the invention, any reference material representing an element in one figure will represent the same element in any other figure. A preferred embodiment of the present connector assembly is described in connection with FIGS. 1 to 21. A connector assembly of the preferred embodiment comprises a male connector 100 and a female connector 200 capable of mating with each other.

The male connector 100 preferably comprises at least one conductive element, such as pins 110, held by a male plug body 120 including a gripping portion 140 and a head portion 130. The head portion 130 includes a distal end 190, a proximal end 191, and a plurality of raised elements extending radially outward from the head portion 130.

Figure 5:
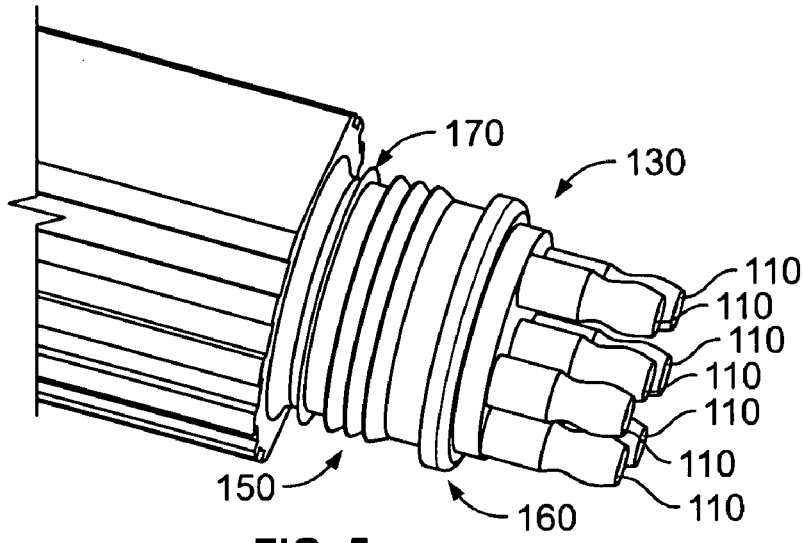
FIG. 5 is an enlarged view of FIG. 1.
Figure 6:
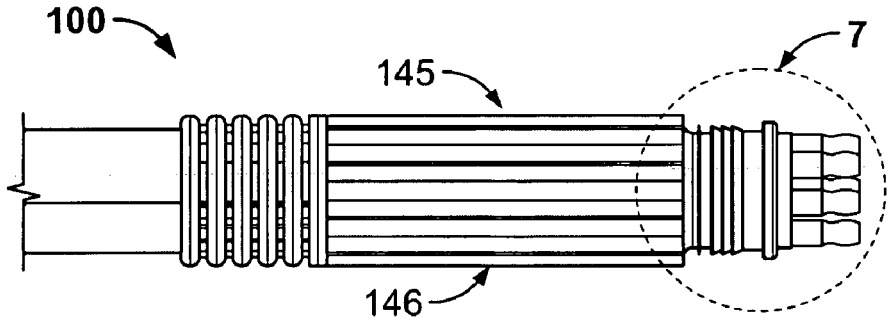
FIG. 6 is a side view of the male connector of FIG. 1.
Figure 7:
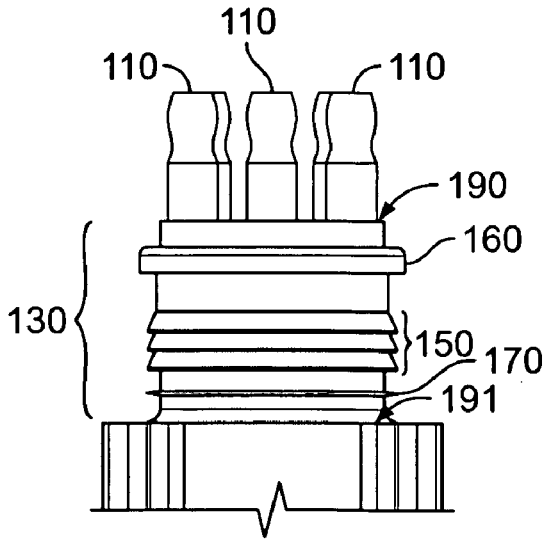
FIG. 7 is an enlarged view of FIG. 6.
Figure 8:
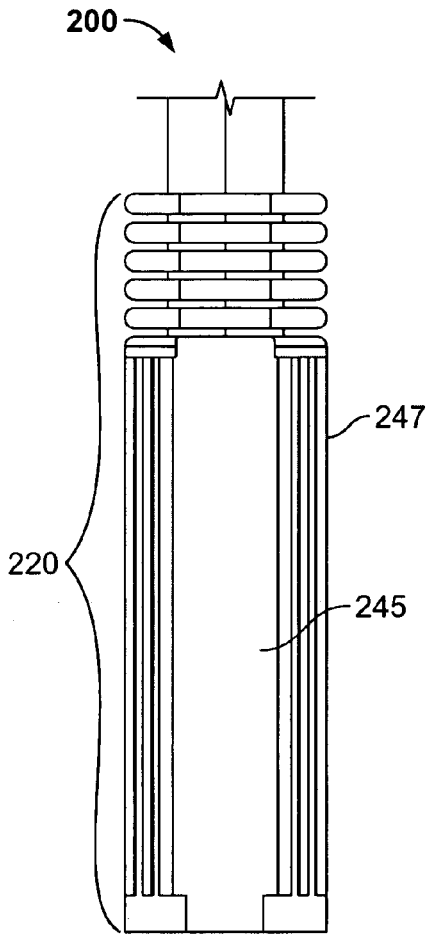
FIG. 8 is a top view of an embodiment of a female connector of the present invention.
Figure 9:
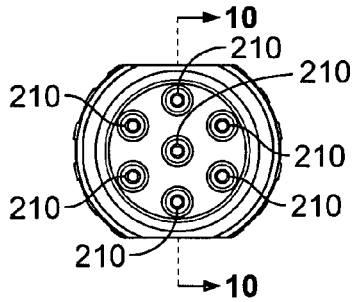
FIG. 9 is a frontal view of the female connector of FIG. 8.
Figure 10:
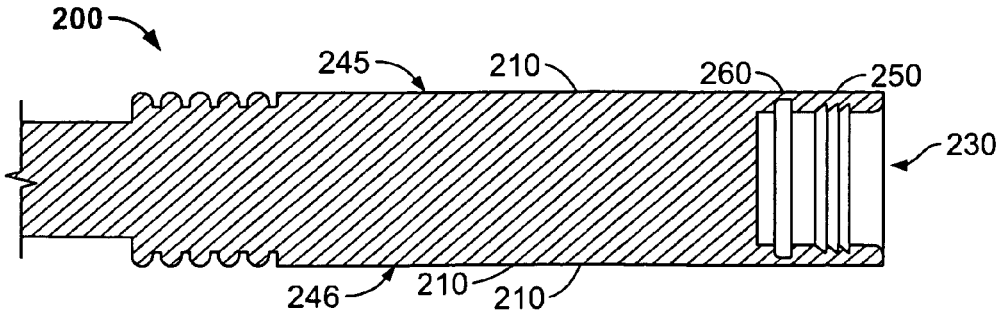
FIG. 10 is a partial sectional side view of the female connector of FIG. 8 wherein the receiving portion and terminals are shown in cross section.
Figure 11:
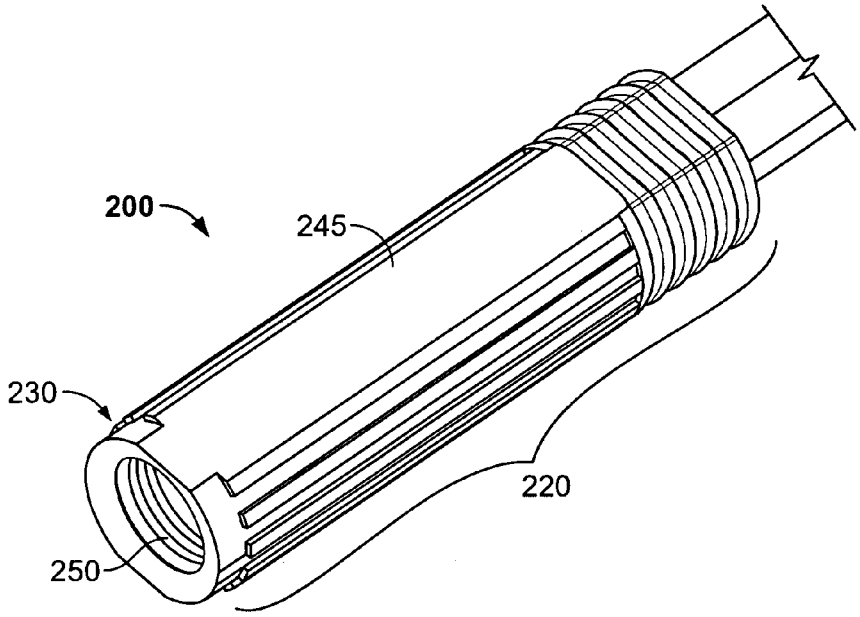
FIG. 11 is a perspective view of the female connector of FIG. 8.
Figure 12:
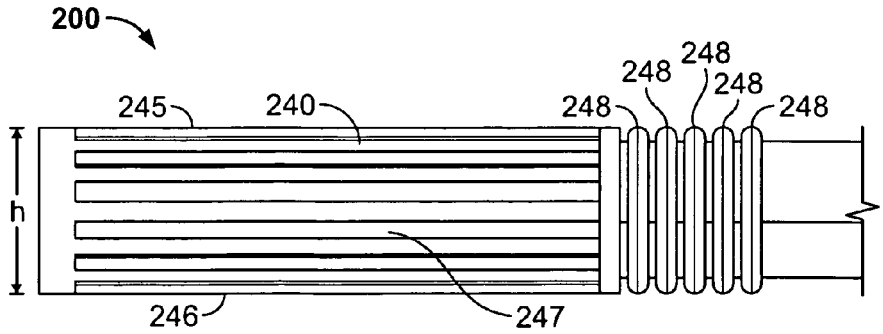
FIG. 12 is a side view of the female connector of FIG. 8.
Figure 13:
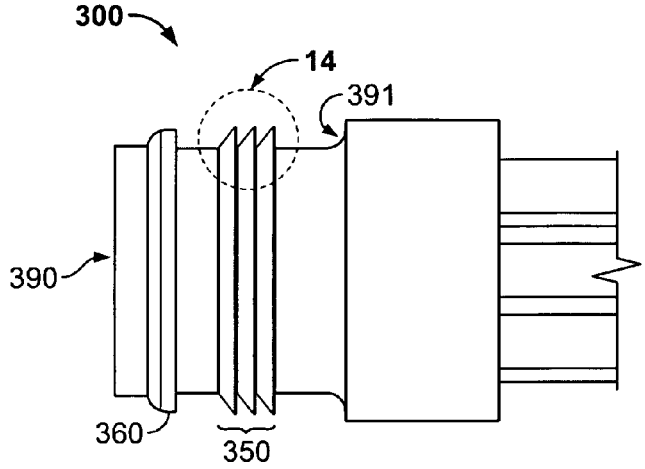
FIG. 13 is side view of a female load bar head used to form an embodiment of a female connector of the present invention.
Figure 14:
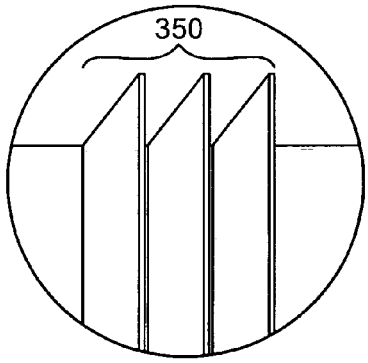
FIG. 14 is an enlarged view of the female load bar head of FIG. 13.
Figure 15:
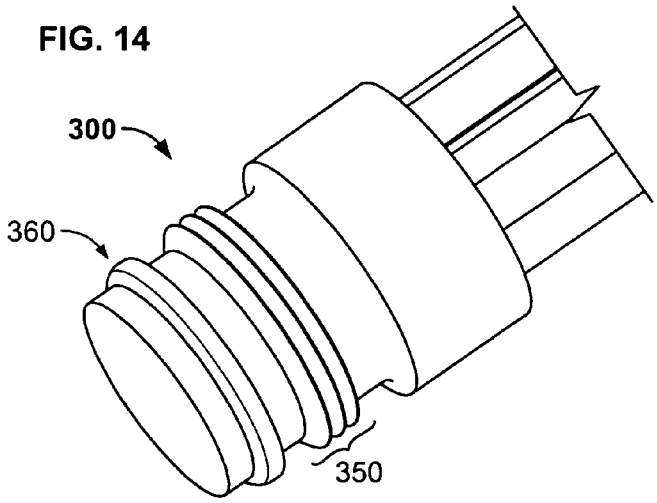
FIG. 15 is a perspective view of the female load bar head of FIG. 13.
Figure 16:
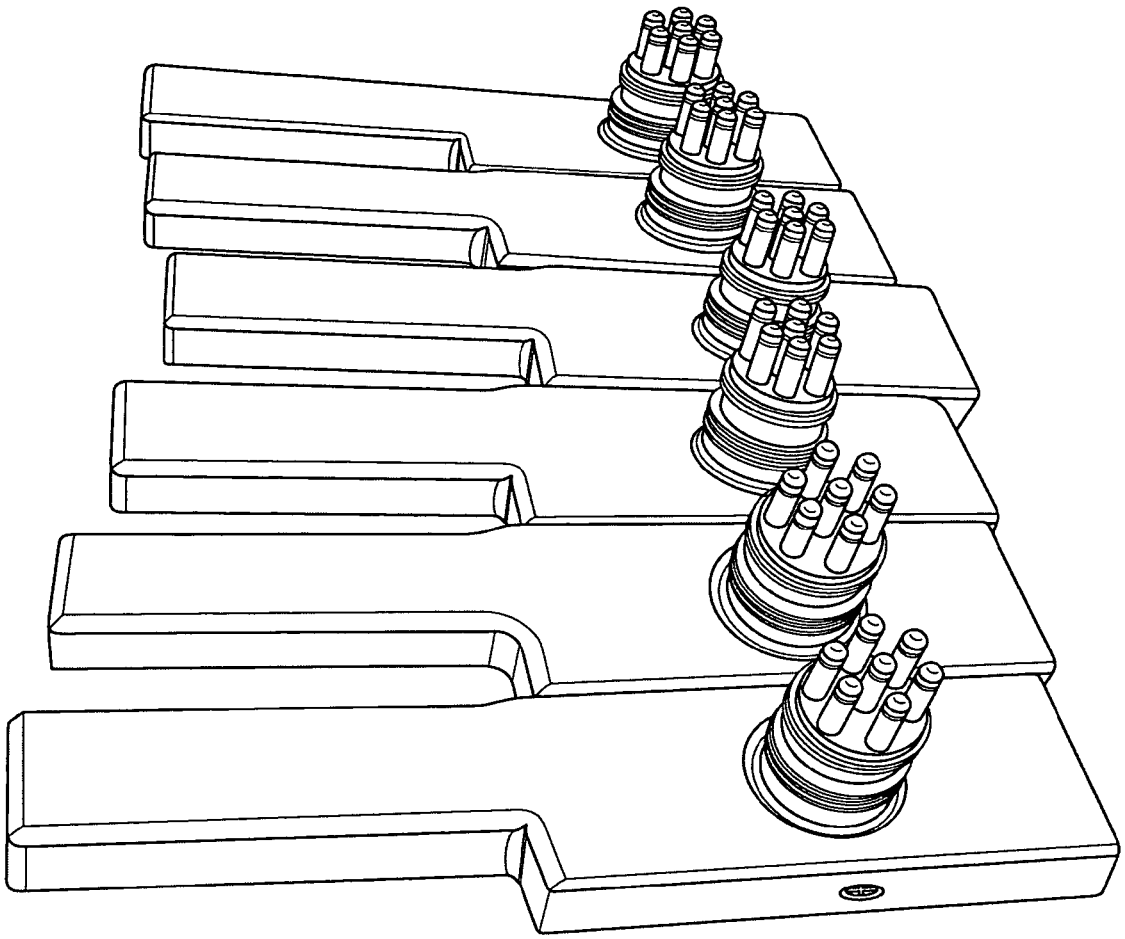
FIG. 16 shows female load bars used to manufacture an embodiment of a female connector of the present invention.
Figure 17:
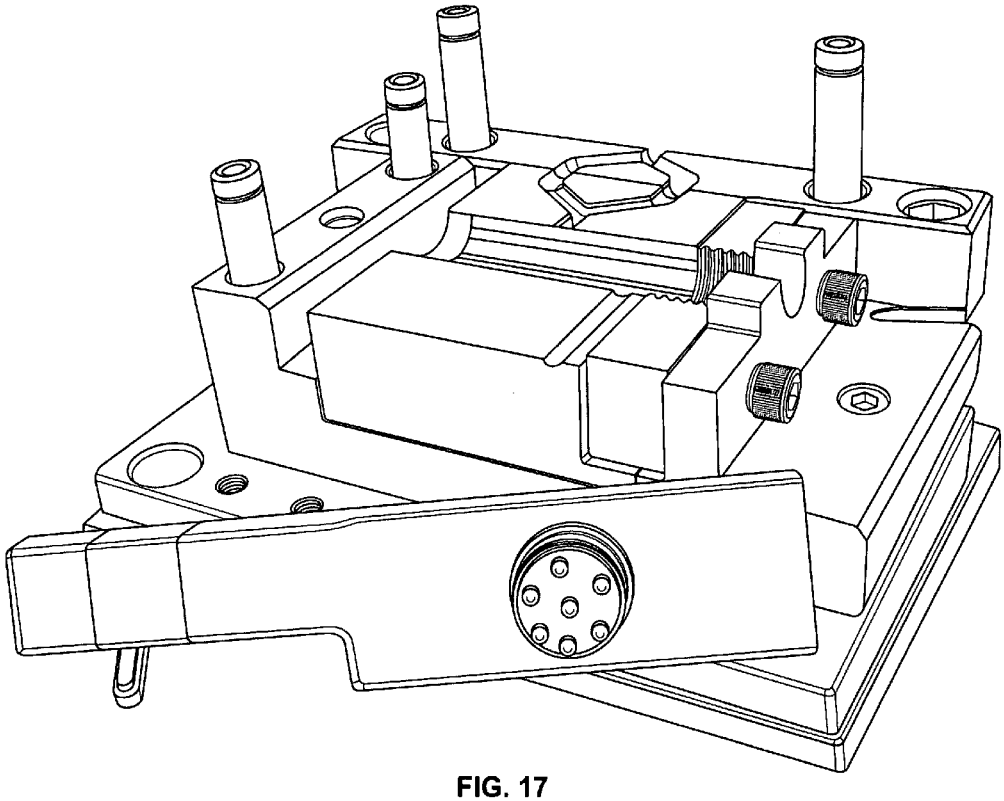
FIG. 17 shows injection molding equipment that can be used to manufacture an embodiment of a connector of the present invention, including a female load bar and the bottom half of a mold for forming a plug body.
Figure 18:
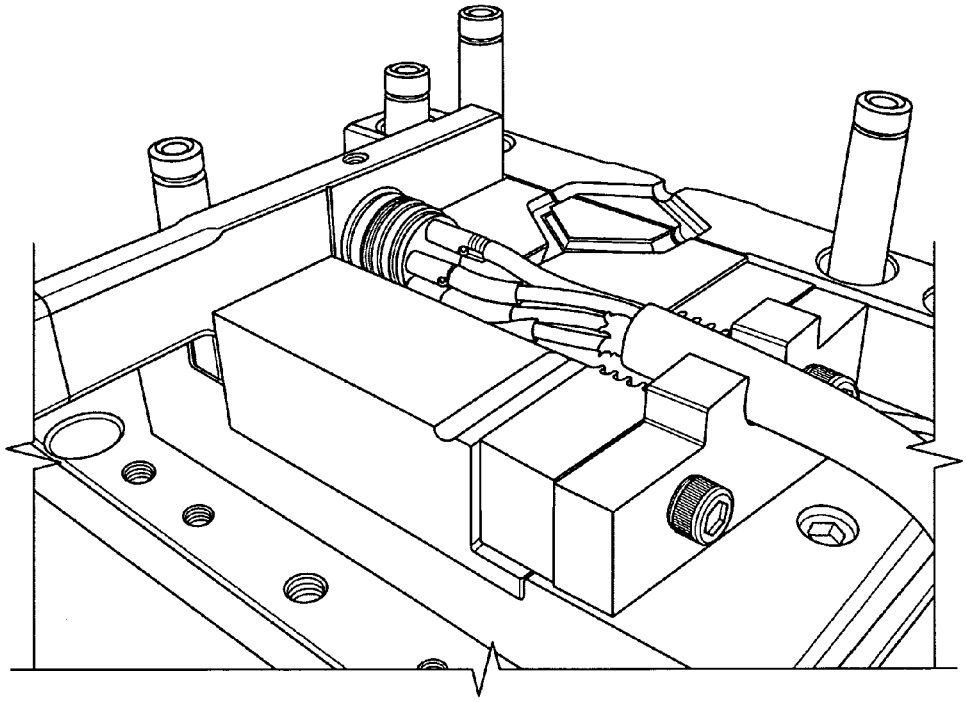
FIG. 18 shows injection molding equipment that can be used to manufacture an embodiment of a connector of the present invention, including a female load bar and the bottom half of a mold for forming a plug body wherein the cable, or wire, is in place and connected to the female load bar.
Figure 19:
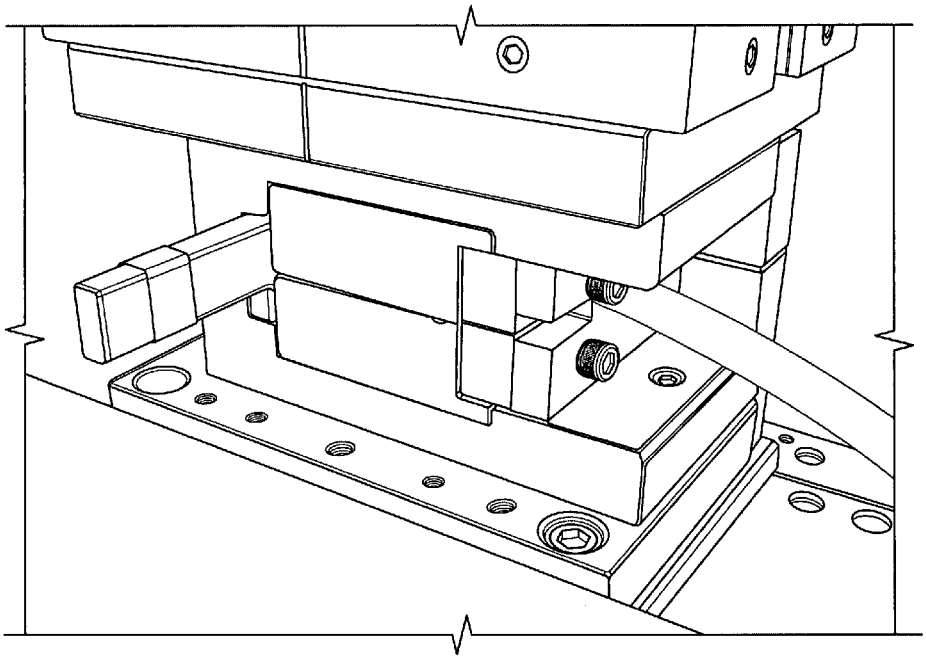
FIG. 19 shows injection molding equipment that can be used to manufacture an embodiment of a connector of the present invention, wherein the molds have been sealed and are ready for injection.
Figure 20:
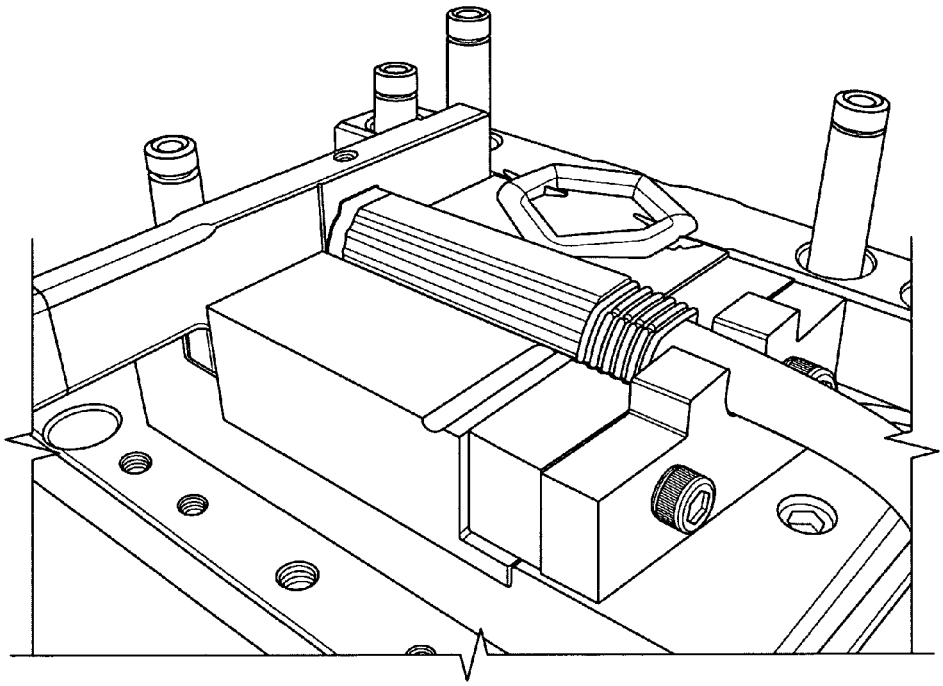
FIG. 20 shows a connector of the present invention in the bottom half of the injection mold used to manufacture it.
Figure 21:
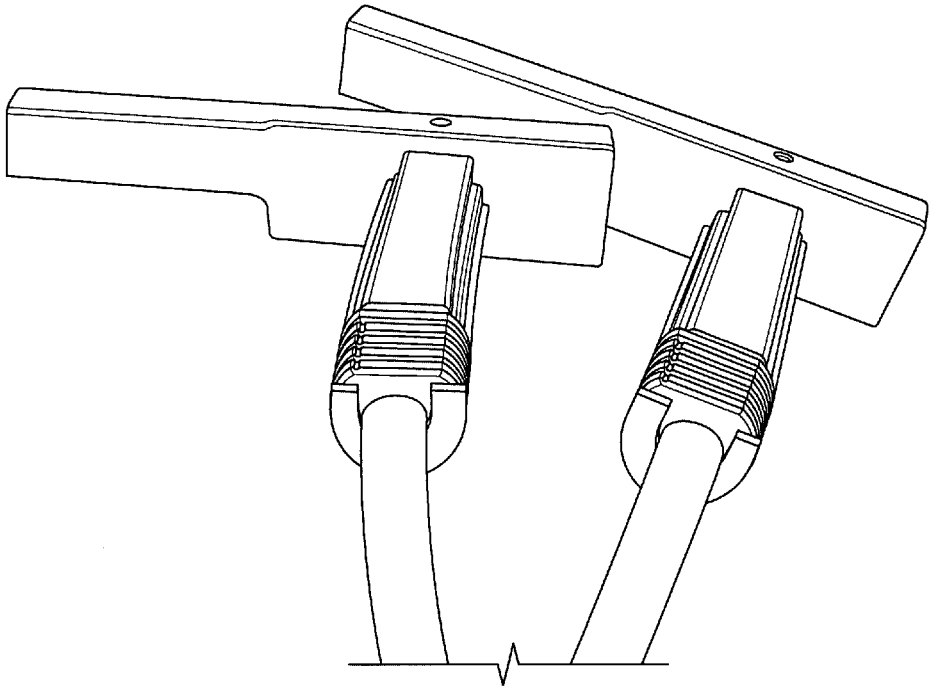
FIG. 21 shows a connector of the present invention attached to a load bar used in the manufacturing process.

In the present embodiment, the raised elements comprise a D-shaped O-ring 160 and a plurality of saw-toothed raised ridges 150. The D-shaped O-ring 160 is preferably located adjacent the distal, or forward, end of head portion 190, and the saw-toothed raised ridges 150 are preferably located proximal to the D-shaped O-ring 160. As shown in FIGS. 5 and 7, a thin wiper blade 170 is also preferably provided on the head portion 130 towards its proximal end, aft of the saw-toothed raised ridges 150.

The male and female connectors 100, 200 of the preferred embodiment have a standard 7 pin terminal layout for 0.180 inch pins 110 and mating sockets 210, respectively. In other embodiments more or less conductive terminals may be employed. Furthermore, in other embodiments, pin(s) 110 may be provided on the female connector 200 and socket(s) 210 may be provided on the male connector 100. The plug bodies 120, 220 of the male and female connectors 100, 200 preferably have rounded sidewalls with lateral ribs 147, 247, and are less than 1.050 inches in height. The plug bodies 120 and 220 of male and female connectors 100, 200 also preferably include a strain relief feature, such as a plurality of radially extending ribs 148, 248 located at the proximal end of the respective plug bodies, where the wire 180 enters the plug body. (See FIG. 1.)

The male and female plug bodies 120, 220 are preferably formed of a PVC material. However, other injection moldable plastics may also be used. Further, the male plug body 120 is preferably harder than the female body 220. Further, it is desirable for the male plug body 120 to be made from a substantially rigid plastic while the female plug body 220 is formed from a flexible plastic. Preferably, the hardness of the male plug body 120 exceeds the hardness of the female plug body 130 by 5 or more points on the Shore A hardness scale, more preferably by 10 or more points, and even more preferably by 15 or more points. A preferred combination is a male body 120 having a hardness of approximately 90 A on the Shore A scale and a female body 220 having a hardness of approximately 75 A. Other male/female hardness combinations may be employed. It is less preferable to employ a male/female connector assembly where both plug bodies are of equal hardness exceeding 85 A on the Shore hardness scale. In such a case, the connector assembly cannot be disassembled without damaging one of the connectors.

The female plug body 220 may have a hardness as low as 60 A though this is less preferable than using a plastic with a hardness in the range of about 70 A to 80 A, and more preferably about 72 A to 78 A.

While PVC is a preferred material for both the male and female plug bodies, materials other than PVC are known in the trade and may be used with acceptable results if they can be suitably injection molded to yield plug bodies in the hardness ranges noted above.

The female connector 200 comprises at least one mating conductive terminal, such as sockets 210, and a female plug body 220 including a receiving portion 230 and a gripping portion 240. The receiving portion 230 of the female plug body 220 is adapted to receive the head portion 130 of the male connector 100 and includes a plurality of recessed areas adapted to interlock with the raised elements of the head portion of the male connector. Thus, where the head portion 130 of the male connector 100 has a D-shaped O-ring 160, a plurality of saw-toothed raised ridges 150, then the receiving portion 230 of the female connector 200 preferably will include recessed portions 250, 260 designed to removably interlock with the D-shaped O-ring and saw-toothed raised ridges of the head portion.

The receiving portion 230 preferably does not have a preformed recess to accept the male body's thin wiper blade 170. As noted, the male body 120 is preferably made of a harder material than the female body 220. Thus, when the male body 120 is brought into mating engagement with the female body 220, the thin wiper blade 170 presses into the interior of the receiving portion 230 of the female body. This engagement between the wiper blade 170 of the male connector and the interior of the female connector helps create a seal that protects the connection from the elements.

In the preferred embodiment, the male and female connectors 100, 200 can be brought into mating engagement without excessive force but, after they are engaged, are semi permanently attached in that they are very difficult to separate. In addition, the conductive terminals held by the male and female connector bodies are well sealed and protected against the elements. The male and female connectors 100, 200 may, however, still be separated without damaging the connectors. Further, the male and female plug bodies 120, 220 are preferably configured to accept a clamp though a clamp is not necessary to create a semi-permanent, well-sealed connection with the connector assembly of the present invention. When a clamp is applied, however, the connector becomes nearly inseparable until the clamp is removed. In addition, the clamp helps cause the wiper blade to bite into the receiving portion, increasing the effectiveness of the connection and increasing the ability of the connector to resist permeation of the elements. A clamp such as a Phillips Industries HW-14 clamp can be used in connection with the described embodiment of the present invention.

Turning now to the manufacturing aspects of the present invention (see FIGS. 16–21), preferably the head portion 130 and the gripping portion 140 of the male plug body 120 are integrally formed in an injection molding process. Similarly, the receiving portion 230 and the gripping portion 240 of the female plug body 220 are also preferably integrally formed in an injection molding process.

An Autojector 35-ton vertical C-clamp injection molding machine may be used to form the male and female plug bodies 120, 220. The Autojector is preferably provided with a shuttle table. The injection material preferably is placed in the hopper. It is preferable to set the temperature zones on the Autojector machine as follows: zone one, or the rear zone, is set at 325 degrees Fahrenheit, zone two, or the barrel zone, is set to 325 degrees Fahrenheit and zone three, or the nozzle zone, is set to 375 degrees Fahrenheit.

The mold can be made out of hardened A2 tool steel heat treated to have a hardness of approximately RC65. The mold is comprised of a bottom mold base and a top mold base. The bases preferably hold a modular mold comprising a cavity section for forming the plug body, a strain relief section for forming the radial ribs, and a wire rail section. This mold accepts a load bar that slides in and out of the mold assembly.

The process preferably begins by loading the terminals onto the load bar in a predetermined position based on the print load configuration. Then the load bar preferably is placed into the mold cavity. The wires are preferably twisted and arranged from touching the walls of the mold cavity and pushed tightly onto the load bar terminals pins. Preferably, a bonding material, preferably Weldon 2001, is then applied to the cable jacket area where it is in contact with the wire rail.

After the mold has closed, the machine injects the molten material. The primary injection should preferably last approximately 5 seconds, after which a secondary injection pressure preferably is applied for approximately 20 seconds. After this is completed, the mold should cool preferably approximately 10 seconds before it is opened. The mold bottom is then preferably set aside to continue cooling while the same mold top closes on another mold bottom. After this, the load bar and molded connector are removed from the mold to continue cooling for three more cycles, after which the load bar is separated from the connector.

In a preferred embodiment, the gripping portions 140, 240 of both the male and female plug bodies 120, 220 have flat top 145, 245 and bottom 146, 246 portions and curved sidewalls 141, 241. Preferably, the curved sidewalls 141, 241 have lateral, or longitudinal, ribs along their side 147, 247. It is believed that the lateral ribs play a beneficial role in the manufacturing process in that they tend to channel the molding material as it is injected into the mold. It is believed that this channeling effect helps create a buffer which helps prevent the internal wires of the connector from migrating towards the edges of the mold during the injection molding process. Thus, the lateral ribs are believed to play a beneficial role in allowing a connector having a reduced form factor such as the connector of the present invention. Twisting the wires 180, 280 before molding also helps keep them from migrating during molding.

Where a connector of the present invention has lateral ribs and is formed through injection molding, it is beneficial to have the injection point 190, 290 for the mold be between two ribs along the centerline of the connector 100, 200. This tends to reduce the need for removing the nub often left from injection molding processes because to the extent that any nub is left, it is situated between the ribs and does not deleteriously effect the form factor of the connector.

The receiving portion 230 of the female plug body 220 can be formed by using a female load bar head 300. The load bar head 300 for forming the receiving portion 230 of the described embodiment preferably has protrusions for mating with and holding in place the conductive terminals for the female connector (see FIGS. 16–21), a distal end 390, a proximal end 391, a D-shaped O-Ring 360, and 3 saw-tooth shaped ridges 350. When manufacturing the female connector, it may be beneficial to remove the load bar before the part has cooled completely. Once the part has completely cooled, it may become difficult to separate from the load bar.

The load bar for forming a female connector of a preferred embodiment having seven 0.180 inch pins in a standard layout preferably is configured as shown in FIGS. 13–16 and preferably has the following dimensions:

Length of head portion: 0.765 inches.

Distance from distal end to beginning of D-Shaped O-Ring: 0.109 inches.

Distance from distal end to end of D-Shaped O-Ring: 0.203 inches.

Distance from distal end to beginning of first saw-toothed ridge: 0.343 inches.

Distance from distal end to end of third saw-toothed ridge: 0.531 inches.

Interior radius: 0.41 inches.

Height of the D-shaped O-Ring: 0.065 inches.

Height of the saw-toothed ridges: 0.055 inches.

The male connector of this embodiment shall be preferably configured in a similar manner so that the male and female connectors can be brought into mating engagement.

Having described the present invention by reference to certain of its preferred embodiments, it is respectfully submitted that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

I claim:

1. A connector assembly comprising:

a male connector, the male connector comprising a plurality of conductive terminals held by a male plug body including a head portion and a gripping portion, the head portion including a plurality of raised elements extending radially outward from the head portion; and a female connector, the female connector comprising a plurality of mating conductive terminal held by a female plug body including a receiving portion and a gripping portion, the receiving portion adapted to receive the head portion of the male connector and including a plurality of recessed areas adapted to interlock with the raised elements of the head portion;

wherein said conductive terminals held by the female plug body are configured to mate with the conductive terminals of the male plug body when the head portion is received by the receiving portion; and wherein the male plug body and the female plug body both have a substantially flat top portion, a substantially flat bottom portion, and rounded sidewalls, said sidewalls having lateral ribs; and wherein the male plug body and the female plug body both have a height not exceeding 1.10 inches.

* * * * *